US007963820B2

(12) United States Patent
Ansolabehere

(10) Patent No.: US 7,963,820 B2
(45) Date of Patent: Jun. 21, 2011

(54) MAGNETIC SPEAKER SOUND MODULE AND BALLOON WITH WEIGHTED SIDE

(75) Inventor: Paul Ansolabehere, Minnetonka, MN (US)

(73) Assignee: Anagram International, Inc., Eden Prairie, MN (US)

( * ) Notice: Subject to any disclaimer, the term of this patent is extended or adjusted under 35 U.S.C. 154(b) by 1273 days.

(21) Appl. No.: 11/586,998

(22) Filed: Oct. 26, 2006

(65) Prior Publication Data

US 2007/0098197 A1 May 3, 2007

Related U.S. Application Data

(60) Provisional application No. 60/731,178, filed on Oct. 28, 2005.

(51) Int. Cl.
*A63H 27/10* (2006.01)

(52) U.S. Cl. ..... 446/220; 446/397

(58) Field of Classification Search ..... 446/220, 446/221, 222, 223, 224, 225, 226
See application file for complete search history.

(56) References Cited

U.S. PATENT DOCUMENTS

| | | | | | |
|---|---|---|---|---|---|
| 3,987,258 | A * | 10/1976 | Tsutsui et al. | ..... | 381/334 |
| 4,638,207 | A | 1/1987 | Radice | | |
| 4,704,934 | A | 11/1987 | Nosrati | | |
| 4,801,478 | A * | 1/1989 | Greenblatt | ..... | 428/7 |
| 4,810,997 | A * | 3/1989 | Kudo et al. | ..... | 340/384.6 |
| 4,823,907 | A | 4/1989 | Hoshi | | |
| 4,917,646 | A | 4/1990 | Kieves | | |
| 4,920,674 | A | 5/1990 | Shaeffer | | |
| 5,108,338 | A | 4/1992 | Margolis | | |
| 5,309,519 | A | 5/1994 | Park et al. | | |
| 5,641,164 | A * | 6/1997 | Doederlein et al. | ..... | 273/237 |
| 5,764,131 | A * | 6/1998 | Twining et al. | ..... | 340/311.2 |
| 6,064,746 | A * | 5/2000 | Nakamura et al. | ..... | 381/351 |
| 6,482,065 | B1 | 11/2002 | Blackman | | |
| 6,687,381 | B2 * | 2/2004 | Yanagawa et al. | ..... | 381/423 |
| 6,821,183 | B2 | 11/2004 | Blackman et al. | | |
| 6,925,191 | B2 * | 8/2005 | Petroff et al. | ..... | 381/423 |
| 7,177,434 | B2 | 2/2007 | Tripoli, III | | |
| 2003/0054728 | A1 * | 3/2003 | Piepenbrink | ..... | 446/220 |
| 2003/0138120 | A1 * | 7/2003 | Tripoli, III | ..... | 381/190 |
| 2005/0057343 | A1 | 3/2005 | Blackman | | |
| 2005/0129261 | A1 * | 6/2005 | Ito et al. | ..... | 381/190 |

OTHER PUBLICATIONS

Paradiso, J.A., The Interactive Balloon: Sensing, Actuation, and Behavior in a Common Object, IBM Systems Journal, 1996, vol. 35, Nos. 3 & 4.

Paradiso, J.A., The Interactive Balloon: Sensing, Actuation, and Behavior in a Common Object, Apr. 1996, pp. 1-23, MIT Media Laboratory.

Measurement Specialties, Inc., Piezo Film Sensors Technical Manual, P/N 1005663-1REV B Apr. 2, 1999, (89 total pages includes, cover, table of contents, and pp. 1-86).

* cited by examiner

*Primary Examiner* — John Ricci

(74) *Attorney, Agent, or Firm* — Gerald E. Helget; Nelson R. Capes; Briggs and Morgan, P.A.

(57) ABSTRACT

A balloon with an attached magnetic speaker sound module. The sound module has a housing containing a magnetic speaker, a power source, and wiring connecting the magnetic speaker the power source. The magnetic speaker is mounted in the housing adjacent an aperture in the housing. The balloon may be constructed of two sides with different weights, with the magnetic speaker adhered to the side with lesser weight so that the balloon floats upright. Alternatively, a counter-weight may be attached to the side of the balloon opposite the magnetic speaker sound module. A method of manufacturing a balloon with an attached magnetic speaker sound module. The balloon is caused to float upright either by constructing the balloon of two sides with different weights and attaching the magnetic speaker sound module to the side with the lesser weight, or by attaching a counter-weight to the side of the balloon opposite the magnetic speaker sound module.

16 Claims, 3 Drawing Sheets

MAGNETIC SPEAKER SOUND MODULE AND BALLOON WITH WEIGHTED SIDE

CROSS-REFERENCE TO RELATED APPLICATION

The present application is based on and claims the benefit of U.S. provisional patent application Ser. No. 60/731,178, filed Oct. 28, 2005, the content of which is hereby incorporated by reference in its entirety.

BACKGROUND OF THE INVENTION

This invention relates to metalized nylon film balloons, and more particularly, to a magnetic speaker sound module for such balloons.

Music modules with various ways of affixation in and onto balloons are illustrated in U.S. Pat. Nos. 4,638,207; 4,704,934; 4,823,907; 5,108,338; 6,482,065; 6,821,183 and Patent Application Publication No. 2003/0138120.

Problems with these music modules in combination with balloons renders them too expensive for general commercialization, technically too complex and often too heavy for a helium filled balloon which is designed to float.

SUMMARY OF THE INVENTION

A magnetic speaker sound music module for a balloon has an ornamental suitably raised face with a peripheral lip or flange. A backer board is adhered to the rear of the ornamental face creating a housing. A central aperture is within the backer board with an annular support rim for supporting the outer portion of a magnetic speaker in a firm manner to encourage the central regions of the speaker to generate optimum music. A power source is contained within the housing and is connected to the speaker by wires. The backer board suitably has an adhesive to allow the ornamental sound module to be affixed to a metalized nylon film balloon.

In one embodiment, in order to keep the balloon floating upright with the magnetic speaker sound music module affixed to one side of the balloon, the balloon is manufactured with two sides having unequal weights, the side opposite the magnetic speaker sound music module having a greater weight. In another embodiment, a counterweight is used.

A principal object and advantage of the present invention is that the magnetic speaker sound module may be attached to any balloon structure made of MYLAR® or metalized nylon film, clear plastic, latex or other vinyl inflated structures.

Another principal object and advantage of the present invention is that the magnetic speaker sound module is inexpensive, simple and easily attaches to any object including balloons.

Another principal object and advantage of the present invention is that using unequal weights for the two sides of the balloon permits the balloon to float upright with the sound module attached.

Another principal object and advantage of the present invention is that a counterweight may be attached to the side of the balloon opposite the magnetic speaker sound module to permit the balloon to float upright with the sound module attached.

DETAILED SPECIFICATION

Figure 1:
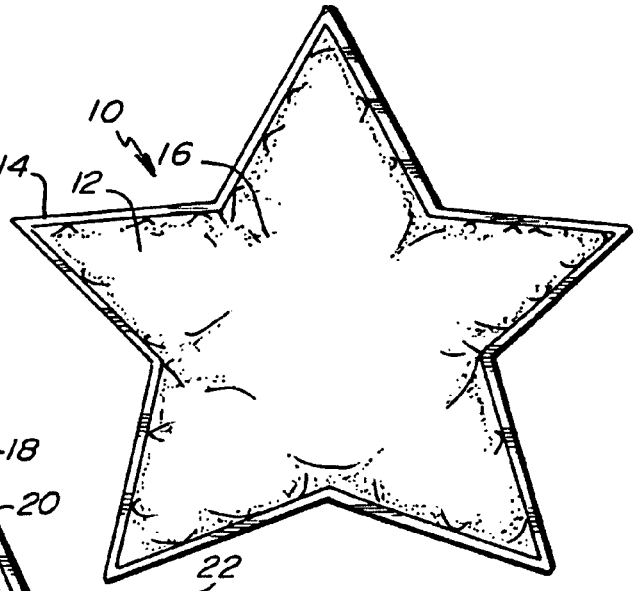
FIG. 1 is a front elevational view of the first embodiment of an ornamental sound module for a balloon.
Figure 2:
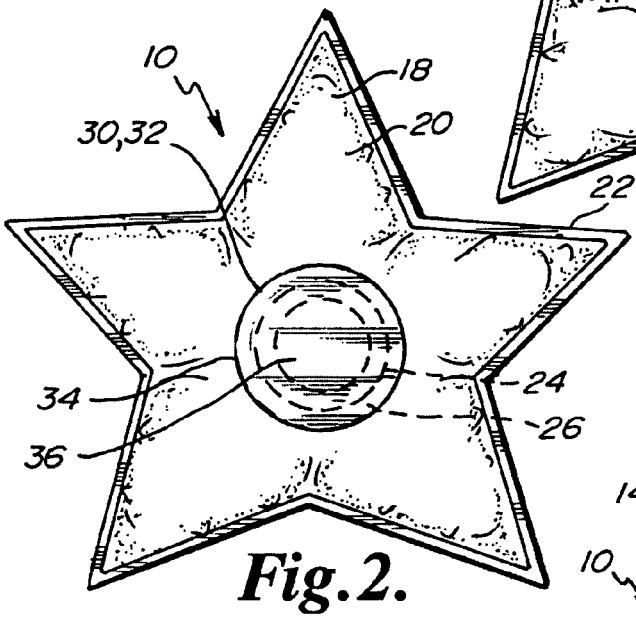
FIG. 2 is a rear elevational view of the module.
Figure 3:
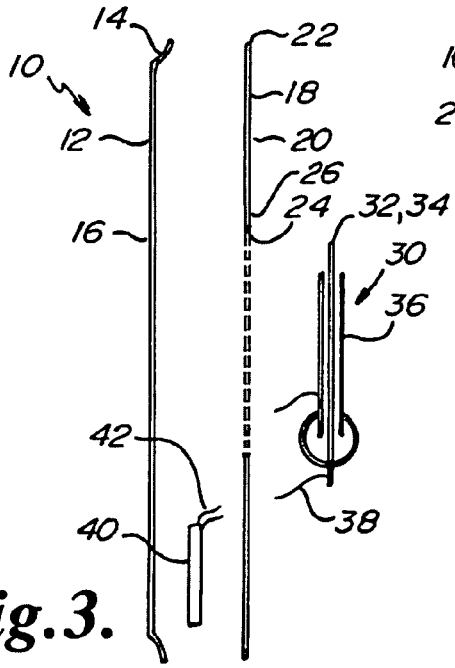
FIG. 3 is an exploded schematic side elevational view of the module.
Figure 4:
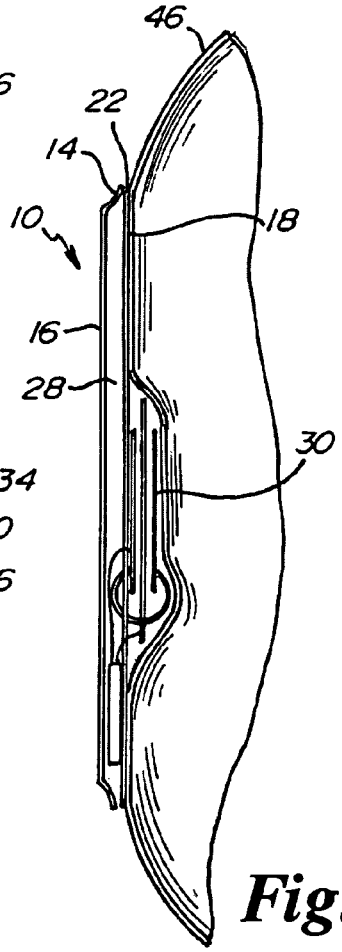
FIG. 4 is a side elevational schematic of the assembled module attached to a balloon.
Figure 5:
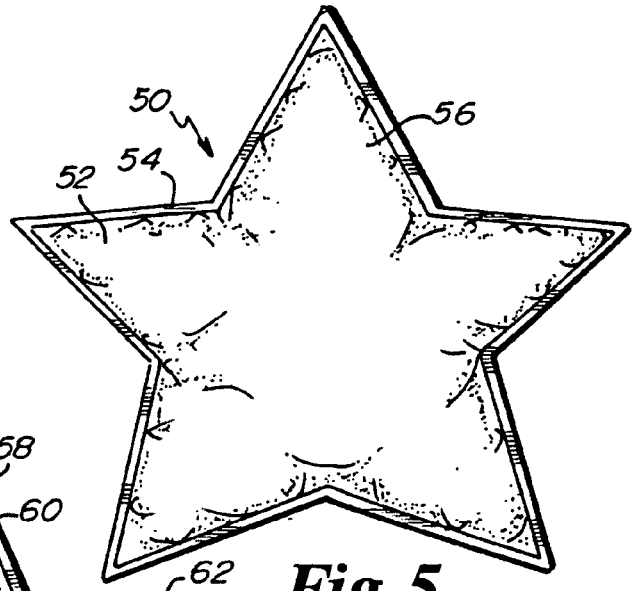
FIG. 5 is a front elevational view of the second embodiment of an ornamental sound module for a balloon.
Figure 6:
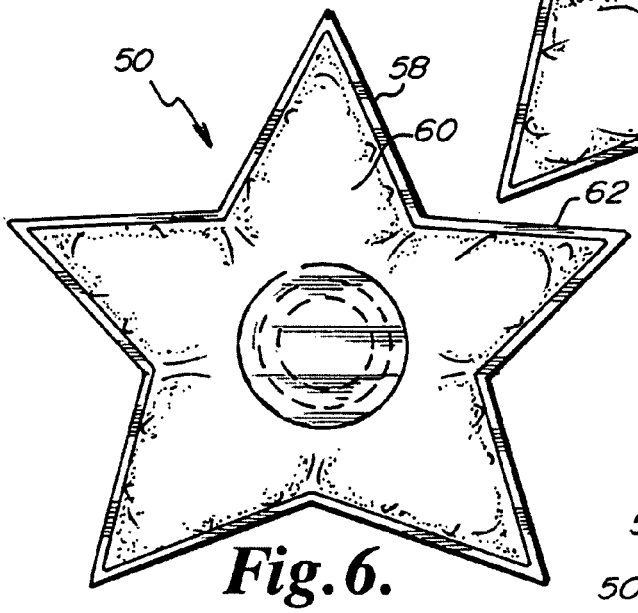
FIG. 6 is a rear elevational view of the second embodiment of FIG. 5.
Figure 7:
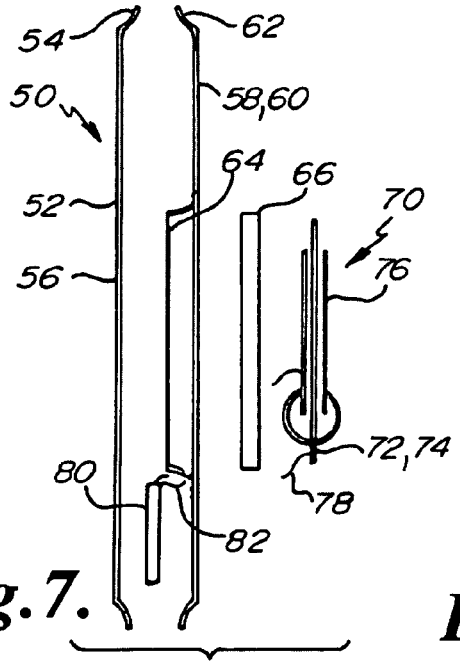
FIG. 7 is an exploded schematic side elevational view of the second embodiment.
Figure 8:
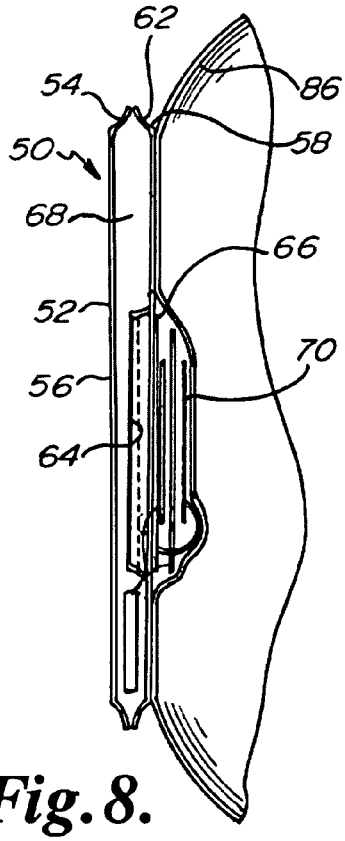
FIG. 8 is a schematic side elevational view of the module assembled and mounted to a balloon.

An ornamental sound module 10 for a balloon 46 in its first embodiment is shown in FIGS. 1 through 4.

The module 10 has a raised star ornamental front portion 12 suitably made of plastic having a peripheral lip or flange 14 therearound and a front face 16 which suitably may be subject to further artistic renderings. The backer board 18 is suitably made of light weight styrofoam and has a face 20. The peripheral edge 22 of the backer board 18 suitably has adhesive thereon for securing to the lip or flange 14 of the plastic raised star 12. A central aperture 24 is provided having a buzzer support rim 26 therearound. By adhering the raised star 12 and backer board 18 at their peripheries 14 and 22, housing 28 is created. Piezoelectric buzzer 30 is suitably constructed of a metal disc 32 of relative large diameter having a peripheral edge 34 therearound. Smaller crystal or ceramic plates 36 are fixed to opposite sides of the metal disc 32 and are suitably connected by appropriate wiring 38.

Within housing 28 is a circuit board 40 which suitably supports a sound chip, a switch, a battery and wires 42 for connection to the wires 38 of buzzer 30. The switch may be mechanical, electronic or a motion detector.

The ornamental sound module 10 maybe adhered to a metalized nylon film balloon 46, or other inflated object suitably made of clear plastic latex or vinyl, by adhesive on face 20.

Referring to FIGS. 5 through 8 the second embodiment of the ornamental sound module 50 for a balloon 86 may be viewed.

The sound module 50 has a raised star front portion 52 with a peripheral lip or flange 54 and a front face 56 which may further be ornamentally decorated. In this embodiment, the backer board 58 is a second raised star like portion suitably made of plastic having a face 60. A peripheral edge 62 of the backer board 58 is suitably adhered to the peripheral flange 54 of the front raised star portion 52 thereby creating housing 68 therewithin. Backer board 58 suitably has a central recess 64 which supports a plastic spacer 66 which may be adhered thereat.

A piezoelectric buzzer 70 suitably has a metal disc 72 with a peripheral edge 74 and crystal or ceramic plates 76 suitably connected by wiring 78. The buzzer 70 is adhered to the plastic spacer 66 which is adhered within the central recess 64. Within the housing is a circuit board 80 suitably supporting a sound chip, switch, battery and wires 82 to be connected to the buzzer 70. Adhesive maybe applied to the backer board 58 at face 60 with a film protecting the adhesive quality until use. At the appropriate time, the liner is removed and the ornamental sound module 54 may be adhered to a metalized nylon film balloon or other clear plastic, latex or other vinyl inflatable objects.

Figure 9:
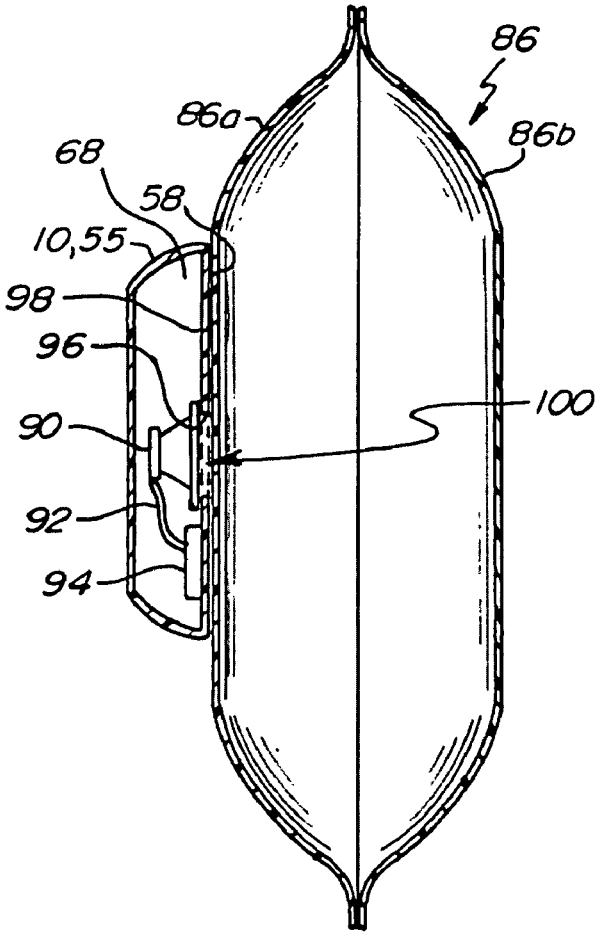
FIG. 9 is a schematic side elevational view of a first embodiment of a magnetic speaker sound module.

A first embodiment of a magnetic speaker sound module 55 attached to a balloon is shown in FIG. 9.

As in the previous embodiment of the ornamental sound module, backer board 58 is suitably adhered to the peripheral flange 54 of the front raised star portion 52 thereby creating housing 68 therewithin. The sound module 10, 55 may preferably comprise, within housing 68, a magnetic speaker 90 attached suitably by wires 92 to a power source 94. The backer board 58 has an aperture 96 therethrough into the housing 68 with a support rim 98 for the magnetic speaker. The magnetic speaker 90 is positioned so that is adjacent to the aperture 96, with sound from the magnetic speaker 90 being transmitted through the aperture 96. When the sound module 55 is adhered to the balloon 86, a gap or air column 100 remains between the aperture 96 and the balloon 86. In the first embodiment, the balloon 86 is constructed of two pieces 86*a*, 86*b* of film of unequal weight. The sound module 55 is attached to side 86*a* by adhesive. In order for the balloon 86 to float upright with the sound module 55 attached to side 86*a*, side 86*b* must have a greater film weight than side 86*a*.

For example, but without limitation, Applicant has found that a desired film weight for side 86*a* is about 12.61 grams while a desired film weight for side 86*b* is about 18.5 grams. These weights can be achieved by manufacturing side 86*a* from 40 gauge metallized nylon film of 7.9 grams extruded weight. The film weighs about 152 milligrams per 9.375 square inches. With approximately 778 square inches of surface area, side 86*a* will have a weight of approximately 12.6 grams. Side 86*b* may be suitably constructed of 48 gauge metallized nylon to yield a weight of about 18.5 grams. The total weight of the two sides 86*a*, 86*b* will thus be about 31.1 grams.

In contrast, a typical balloon manufactured with 40 gauge film on both sides will have a weight of about 25.23 grams. Such a balloon, having a volume of helium with an overall lift of 70.23 grams will lift the 25.23 gram film with an overall lift of (70.23-25.23) or 45 grams.

The difference between the film weights of a standard balloon and of the balloon of FIG. 9 is (31.1-25.2) or 5.9 grams. This means that compared to the standard balloon, the balloon of FIG. 9 will have an overall lift of (45-5.9) or 39.1 grams. It is anticipated that the speaker module 55 will have a weight of about 25 grams, leaving a net float of (39.1-25) or 14.1 grams. This is anticipated to keep the balloon 86 floating vertically.

The speaker of the sound module 55 may suitably have the following characteristics:

Rated impedance (ohms): 8+−15%.

Rated (Max) Power (W): 0.25 (0.5).

Resonance frequency (Hz): 0-5000.

Sound pressure level (db): 85+−−3.

Magnet (g): 1.1

Operating temperature (Degree C.): −10−+40.

Applicant has further found that constructing the magnetic speaker sound module 55 with aperture 96 results in an air column 100 between the backer board 58 and the balloon 86 having a depth of about 7 to 10 mm. This air column produces significantly enhanced sound levels.

Table 1 illustrates sound testing with the sound module 55 attached to the balloon 86.

In the Table, the following notation is used:

A=12" away from front of device (Hand held)

B=12" away from back of device (Hand held)

C=12" away from back of balloon (Floating, center of balloon)

D=12" away from front of balloon (Floating, center of balloon)

TABLE 1

| Tune | A | Db B | C | D |
|---|---|---|---|---|
| SING A TUNE - IT'S A BOY: BABY FACE | 89.8 | 85.7 | 78.8 | 75.7 |
| ANAGRAM INTL - I THINK I LOVE YOU | 90 | 92.5 | 82.8 | 71.5 |

Figure 10:
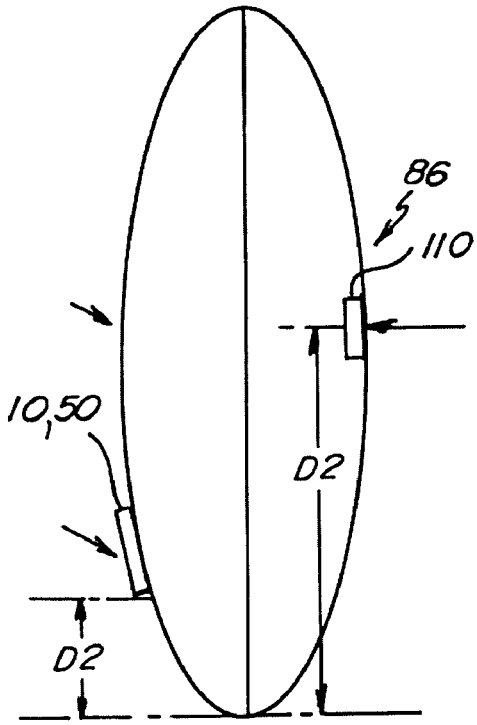
FIG. 10 is a schematic side elevational view of a second embodiment of a magnetic speaker sound module.

A second embodiment of a magnetic speaker sound module 55 is shown in FIG. 10. The magnetic speaker sound module 55 may be as previously described in the first embodiment. However, rather than manufacturing one side of the balloon with film of a greater weight, a counterbalance 110 is used to offset the weight of the sound module 55. The counterweight 110 is positioned internally in the balloon to counteract the tip of the balloon caused by the sound module in order to bring the tip angle to an acceptable level.

Clearly, the relative position of the counterbalance 110 and its weight depends on the weight of the sound module 55. Applicant has found that the sound module 55 is preferably placed a distance D1 about 5.5 inches from the bottom of the balloon, and the counterbalance a distance D2 about 15.25 inches from the bottom of the balloon. When so placed, the weight of the counterbalance 110 depends on the weight of the sound module 55 according to the following table:

TABLE 2

| Weight of sound module (grams) | Weight of counterbalance (grams) |
|---|---|
| 15 | 3 to 5 |
| 19 | 4 to 6 |
| 22 | 5 to 7 |
| 25 | 6 to 8 |
| 28 | 7 to 9 |
| 31 | 8 to 10 |

The present invention also comprises a method of manufacturing a balloon with a magnetic speaker sound module, comprising the steps of (a) constructing a magnetic speaker sound module 55 comprising a housing 68 with an aperture 96 therethrough, the housing containing a magnet speaker 90 adjacent the aperture, a power source 94, and wiring 92 connecting the magnetic speaker to the power source;

(b) constructing a balloon 86 with two sides, one side 86*a* having a lesser weight than the other 86*b*; and (c) adhering the magnetic speaker sound module to side 86*a* of the balloon with the lesser weight.

The present invention also comprises a method of manufacturing a balloon with a magnetic speaker sound module, comprising the steps of:

(a) constructing a magnetic speaker sound module 55 comprising a housing 68 with an aperture 96 therethrough, the housing containing a magnet speaker 90 adjacent the aperture, a power source 94, and wiring 92 connecting the magnetic speaker to the power source;

(b) adhering the magnetic speaker sound module 55 to one side of the balloon 86; and (c) attaching a counter-weight 110 to the side of the balloon opposite the side to which the magnetic speaker sound module is adhered, the counter-weight balancing the weight of the magnetic speaker sound module so that the balloon floats upright.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A magnetic speaker sound module and balloon, the magnetic speaker sound module comprising:

(a) a housing with an aperture therethrough, the housing being adhered to the balloon;

(b) a magnetic speaker in the housing adjacent the aperture;

(c) a power source; and (d) wiring connecting the magnetic speaker to the power source.

2. The magnetic speaker sound module and balloon of claim 1, wherein the housing further comprises a front portion and a backer board secured to the front portion.

3. The magnetic speaker sound module and balloon of claim 2, wherein the front portion further comprises a first peripheral flange there-around and wherein the backer board has a second peripheral flange there-around, the first peripheral flange and the second peripheral flange being joined together to create the housing.

4. The magnetic speaker sound module and balloon of claim 3, wherein the front portion is comprised of a plastic.

5. The magnetic speaker sound module and balloon of claim 4, wherein the backer board further comprises plastic foam.

6. The magnetic speaker sound module and balloon of claim 5, wherein the first peripheral flange is secured to the backer board's second peripheral flange.

7. The magnetic speaker sound module and balloon of claim 6, wherein the first peripheral flange is adhered to the second peripheral flange.

8. The magnetic speaker sound module and balloon of claim 1, further comprising a support rim around the aperture to support the magnetic speaker.

9. The magnetic speaker sound module and balloon of claim 1, further comprising an air column between the backer board and the balloon.

10. The magnetic speaker sound module and balloon of claim 1, wherein the balloon further comprises two sides of unequal weight, and wherein the magnetic speaker sound module is adhered to the side with the lighter weight.

11. The magnetic speaker sound module and balloon of claim 1, wherein the balloon further comprises two sides, the magnetic speaker sound module being adhered to one side and a counterweight being adhered to the other side.

12. A balloon with a magnetic speaker sound module, the magnetic speaker sound module comprising:

(a) a housing with an aperture therethrough, the housing being adhered to the balloon;

(b) a magnetic speaker in the housing adjacent the aperture;

(c) a power source;

(d) wiring connecting the magnetic speaker to the power source; and (e) wherein a force counter-balances the weight of the magnetic speaker sound module so that the balloon floats upright.

13. The balloon with magnetic speaker sound module of claim 12, wherein the balloon has two sides, the magnetic speaker sound module being adhered to the balloon on one side, and the counter-balancing force being provided by the side of the balloon opposite the magnetic speaker sound module having a greater weight than the side of the balloon to which the magnetic speaker sound module is adhered.

14. The balloon with magnetic speaker sound module of claim 12, wherein the balloon has two sides, the magnetic speaker sound module being adhered to the balloon on one side, and the counter-balancing force being provided by a counter-weight attached to the balloon on the side opposite the side of the balloon to which the magnetic speaker sound module is adhered.

15. A method of manufacturing a balloon with a magnetic speaker sound module, comprising the steps of:

(a) constructing a magnetic speaker sound module comprising a housing with an aperture therethrough, the housing containing a magnet speaker adjacent the aperture, a power source, and wiring connecting the magnetic speaker to the power source;

(b) constructing a balloon with two sides, one side having a lesser weight than the other; and (c) adhering the magnetic speaker sound module to the side of the balloon with the lesser weight.

16. A method of manufacturing a balloon with a magnetic speaker sound module, comprising the steps of:

(a) constructing a magnetic speaker sound module comprising a housing with an aperture therethrough, the housing containing a magnet speaker adjacent the aperture, a power source, and wiring connecting the magnetic speaker to the power source;

(b) adhering the magnetic speaker sound module to one side of the balloon; and (c) attaching a counter-weight to the side of the balloon opposite the side to which the magnetic speaker sound module is adhered, the counter-weight balancing the weight of the magnetic speaker sound module so that the balloon floats upright.

* * * * *